US007578351B2

(12) United States Patent
Dallas

(10) Patent No.: US 7,578,351 B2
(45) Date of Patent: Aug. 25, 2009

(54) CONFIGURABLE WELLHEAD SYSTEM WITH PERMANENT FRACTURING SPOOL AND METHOD OF USE

(75) Inventor: L. Murray Dallas, Fairview, TX (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 168 days.

(21) Appl. No.: 11/642,469

(22) Filed: Dec. 19, 2006

(65) Prior Publication Data

US 2008/0087439 A1 Apr. 17, 2008

Related U.S. Application Data

(60) Provisional application No. 60/851,449, filed on Oct. 12, 2006.

(51) Int. Cl.
*E21B 34/02* (2006.01)

(52) U.S. Cl. ..... 166/379; 166/90.1; 166/95.1; 166/88.1

(58) Field of Classification Search ..... 166/379, 166/382, 76.1, 85.4, 84.3, 96.1, 75.13, 95.1
See application file for complete search history.

(56) References Cited

U.S. PATENT DOCUMENTS 3,806,168 A * 4/1974 McGee et al. ..... 285/123.2
4,076,079 A * 2/1978 Herricks et al. ..... 166/308.1
4,562,888 A 1/1986 Collet
5,012,865 A 5/1991 McLeod
5,285,852 A 2/1994 McLeod
5,332,044 A 7/1994 Dallas
5,372,202 A 12/1994 Dallas
5,540,282 A 7/1996 Dallas
5,615,739 A 4/1997 Dallas
5,785,121 A 7/1998 Dallas
5,819,851 A 10/1998 Dallas
6,220,363 B1 4/2001 Dallas
6,289,993 B1 9/2001 Dallas
6,364,024 B1 4/2002 Dallas
6,447,021 B1 * 9/2002 Haynes ..... 285/302
6,626,245 B1 9/2003 Dallas
6,769,489 B2 8/2004 Dallas
6,817,421 B2 11/2004 Dallas
6,817,423 B2 11/2004 Dallas
6,920,925 B2 7/2005 Duhn et al.
7,032,677 B2 4/2006 McGuire et al.
7,040,410 B2 5/2006 McGuire et al.
7,066,269 B2 6/2006 Dallas et al.

(Continued)

OTHER PUBLICATIONS

U.S. Appl. No. 11/544,975, entitled "Retrievable Frac Mandrel and Well Control Stack to Facilitate Well Completion, Re-Completion or Workover and Method of Use," filed Oct. 6, 2006.

*Primary Examiner*—Jennifer H Gay
*Assistant Examiner*—James G Sayre
(74) *Attorney, Agent, or Firm*—Nelson Mullins Riley & Scarborough, LLP

(57) ABSTRACT

A configurable wellhead system is used to efficiently accomplish well completion, re-completion or workover. The configurable wellhead system includes a permanent fracturing spool that is mounted to a casing head of the well and provides a high pressure seal around a top of a casing of the well. The permanent fracturing spool provides full-bore direct access to the casing without the use of a pressure isolation mandrel. A tubing head is mounted to a top of the permanent fracturing spool to complete the configurable wellhead system. A fracturing spool plug secured in a seal bore of the permanent fracturing spool permits equipment mounted above the permanent fracturing spool to be removed without killing the well or inserting a wireline casing plug.

20 Claims, 19 Drawing Sheets

U.S. PATENT DOCUMENTS

| | | | | |
|---|---|---|---|---|
| 7,237,615 | B2 | 7/2007 | Dallas et al. | |
| 7,322,407 | B2 * | 1/2008 | Duhn et al. | 166/75.14 |
| 2003/0029621 | A1 * | 2/2003 | Haynes | 166/381 |
| 2005/0092496 | A1 | 5/2005 | Duhn et al. | |
| 2006/0060349 | A1 * | 3/2006 | Duhn et al. | 166/88.1 |
| 2006/0185841 | A1 | 8/2006 | Swagerty et al. | |
| 2006/0196677 | A1 | 9/2006 | McGuire et al. | |
| 2007/0044977 | A1 * | 3/2007 | Hendrickson et al. | 166/387 |
| 2008/0083539 | A1 * | 4/2008 | Hickie | 166/379 |

* cited by examiner

CONFIGURABLE WELLHEAD SYSTEM WITH PERMANENT FRACTURING SPOOL AND METHOD OF USE

RELATED APPLICATIONS

This application claims the benefit of U.S. application Ser. No. 60/851,449 filed Oct. 12, 2006, the entire disclosure of which is incorporated by reference herein.

FIELD OF THE INVENTION

This invention relates in general to hydrocarbon well completion, re-completion or workover and, in particular, to a configurable wellhead system with a permanent fracturing spool, and a method of using the permanent fracturing spool to facilitate well completion, re-completion or workover.

BACKGROUND OF THE INVENTION

It is well understood that attempts to maintain viable hydrocarbon supplies have necessitated the exploitation of more marginal hydrocarbon production zones. It is also well known that exploiting marginal hydrocarbon production zones requires the use of sophisticated well drilling techniques, such as horizontal drilling and multi-stage well completions. It is further known that most production zones generally require stimulation in order to establish or sustain viable hydrocarbon production. As understood by those skilled in the art, the stimulation of hydrocarbon production zones generally requires pumping high-pressure, often abrasive, fluids into the zones. In order to accomplish this in the past, pressure-sensitive wellhead equipment had to be isolated from those fluids during the stimulation process.

Many wellhead isolation tools have been developed to protect sensitive wellhead equipment while high-pressure stimulation fluids are pumped into subterranean formations. A high-pressure mandrel of those wellhead isolation tools, commonly referred to as a "frac mandrel" provides the pressure isolation through the wellhead. Some wellhead isolation tools also provide full-bore access to a casing of the well in order to permit downhole operations such as logging, perforating, packing and plugging to be performed through the tools. However, prior art wellhead isolation tools have known disadvantages. For example, some are expensive to use due to labor costs associated with delivering and operating them; some cannot be removed from a live well; and some are known to "get stuck" in the wellhead making them difficult or impossible to remove without killing or plugging a casing of the well.

There therefore exists a need for a configurable wellhead system with a permanent fracturing spool that can be left on a wellhead throughout a service life of the well, and can be configured to production requirements after well completion, re-completion or workover is completed.

SUMMARY OF THE INVENTION

It is therefore an object of the invention to provide a configurable wellhead system with a permanent fracturing spool that can be left on a well throughout a service life of the well, and that can be configured or re-configured to production needs after a well completion, re-completion or workover operation is completed.

The invention therefore provides a configurable wellhead system for facilitating well completion, re-completion or workover of a cased well, comprising: a permanent fracturing spool having a top end and a continuous sidewall without side ports, the permanent fracturing spool having a central passage at least as large as a diameter of a casing of the cased well, a bottom flange for mounting to a casing head of the cased well, and high pressure seals for sealing around a periphery of a top end of the casing; and a tubing head having a bottom end that is mounted to the permanent fracturing spool to complete the wellhead system, the tubing head including a tubing bowl, tubing hanger lockdown screws, and side ports that communicate with an annulus of the tubing hanger.

The invention further provides a method of performing a completion, re-completion or workover of a cased well having a casing head, comprising: mounting a permanent fracturing spool to a top of the casing head; mounting a fracturing head to the permanent fracturing spool; mounting a high-pressure valve to a top of the fracturing head; mounting well completion, re-completion or workover equipment to a top of the high-pressure valve; and performing a well completion, re-completion or workover operation using the equipment.

The invention yet further provides a configurable wellhead system for facilitating well completion, re-completion or workover of a cased well, comprising: a permanent fracturing spool having a top end, a continuous sidewall without side ports, a central passage defining a seal bore and having a smallest diameter at least as large as a diameter of a casing of the cased well, a bottom flange for mounting to a casing head of the cased well, and high pressure seals for sealing around a periphery of a top end of the casing; and, a tubing head having a bottom end that is mounted to the permanent fracturing spool to complete the configurable wellhead system, the tubing head comprising a top flange, a tubing bowl, tubing hanger lockdown screws for securing a tubing hanger in the tubing bowl, side ports that communicate with an annulus of the tubing hanger, and at least one side port valve connected to a one of the side ports.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a configurable wellhead system with a permanent fracturing spool that is used for well completions, re-completions or workovers. The permanent fracturing spool provides unobstructed, full-bore access to a production casing of the well to facilitate well completion, re-completion or workover, and remains a part of the completed wellhead. A frac head is connected directly to the permanent fracturing spool and there is no requirement for pressure isolation equipment. The permanent fracturing spool also permits on-site configuration of the wellhead to meet production requirements after a well completion, re-completion or workover procedure is completed. A mating tubing head can be chosen to fit the production pressure requirements of the completed well. The permanent fracturing spool accepts a fracturing spool plug that permits production equipment to be removed from the wellhead if a re-completion or workover operation is required. Well completion, re-completion and workover are thereby facilitated and the cost of these operations is significantly reduced.

Figure 1:
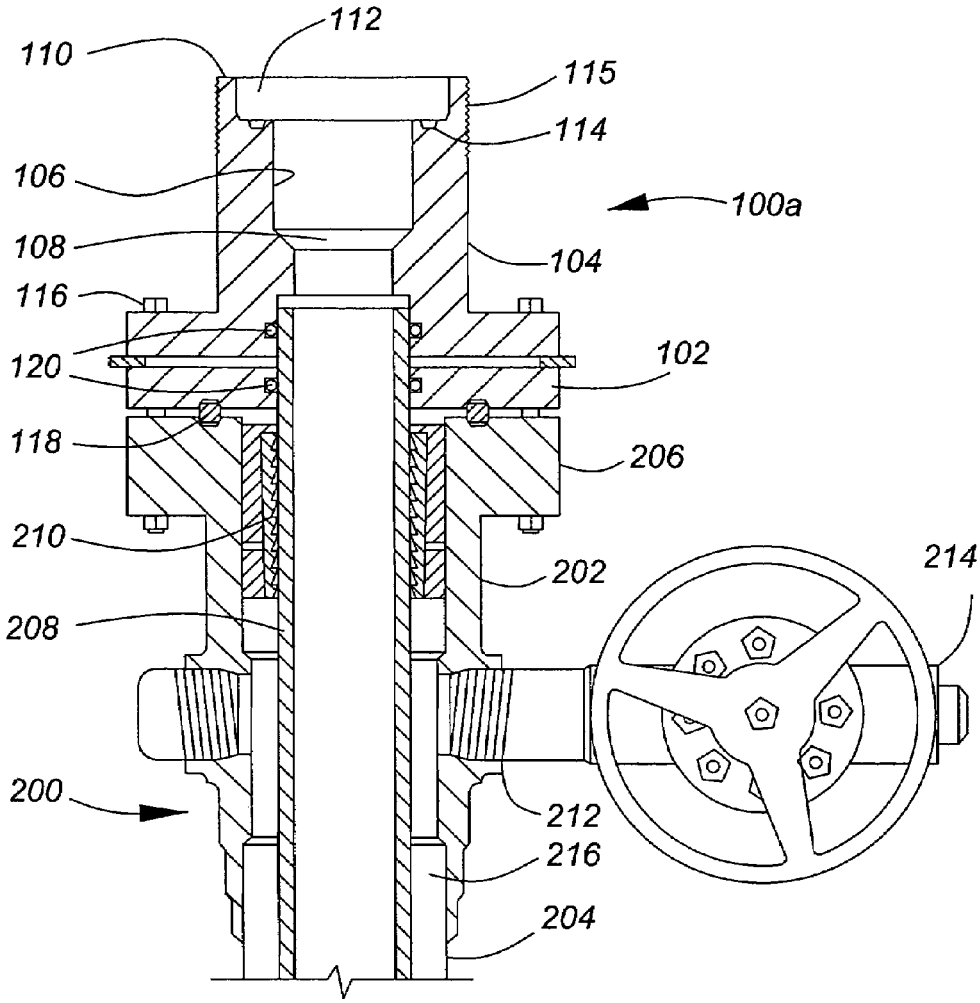
FIG. 1 is a schematic diagram of one embodiment of a permanent fracturing spool in accordance with the invention mounted to a prior art casing head.

FIG. 1 is a schematic cross-sectional diagram of a permanent fracturing spool 100*a* in accordance with the invention mounted to a wellhead 200. The wellhead 200 includes a casing head 202 of a type well known in the art. The casing head 202 is supported by surface casing 204. A production casing 208 is supported by casing slips 210. Side ports 212 of the casing head 202 provide access to an annulus 216 of the surface casing 204. The side port 212 is closed by a side port valve 214. Other types and styles of casing head 202 are known in the art, and it should be understood that permanent fracturing spools 100 can be used in conjunction with any known flanged casing head.

The permanent fracturing spool 100*a* has a continuous sidewall 104 without side ports, and includes a bottom flange 102 that mates with a top flange 206 of the casing head 202. A standard metal ring gasket 118, such as a BX ring gasket, provides a high-pressure seal between the permanent fracturing spool 100*a* and the casing head 202. The sidewall 104 terminates on a top end 110 in a high-pressure threaded union that includes a pin thread 115, the purpose of which will be explained below in more detail with reference to FIG. 4. A central passage through the permanent fracturing spool 100*a* has a smallest diameter that is at least as large as an internal diameter of the casing 208, and includes a seal bore having a sidewall 106 and a bit guide 108. The threaded union at the top end 110 also includes a socket 112 that receives a pin of another component of the high-pressure threaded union, as will also be explained below with reference to FIG. 4. A bottom of the socket 112 includes a metal ring gasket groove 114, which accepts a metal ring gasket described in Applicant's U.S. Pat. No. 7,125,055 which issued Oct. 24, 2006. A plurality of flange bolts 116 secure the permanent fracturing spool 100*a* to the casing head 202. High-pressure seals schematically illustrated at 120 provide fluid seals between the permanent fracturing spool 100*a* and the production casing 208. The high-pressure seals 120 are rated for a minimum of 10,000 psi.

Figure 2:
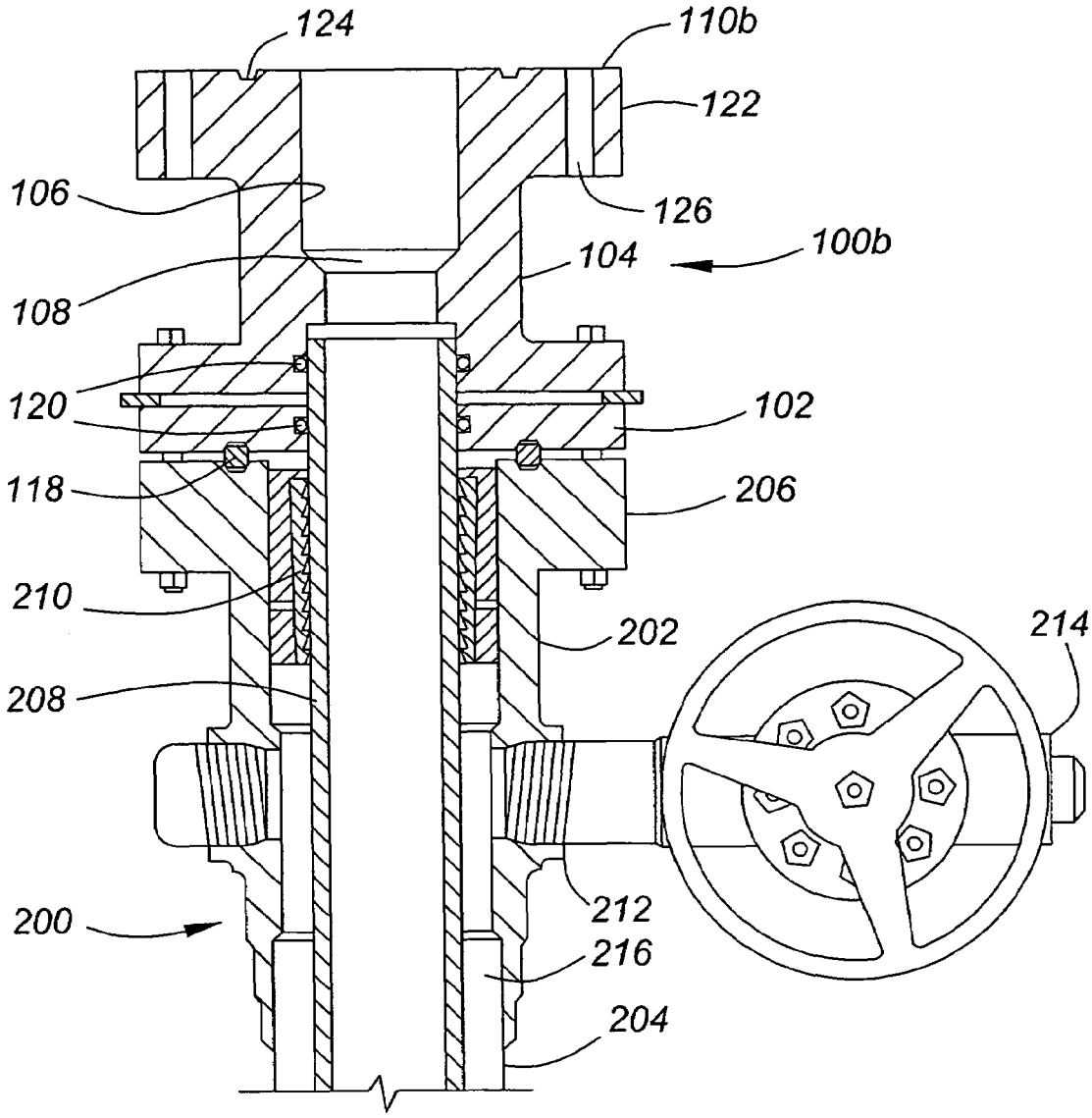
FIG. 2 is a schematic diagram of another embodiment of the permanent fracturing spool in accordance with the invention mounted to the prior art casing head.

FIG. 2 is a cross-sectional diagram of another embodiment of a permanent fracturing spool 100*b* in accordance with the invention. The permanent fracturing spool 100*b* likewise has a continuous sidewall 104 without side ports, and is identical to the permanent fracturing spool 100*a* described above, with an exception that the top end 110*b* terminates in a standard bolted flange 122. The flange 122 includes a standard metal ring gasket groove 124 that accepts a standard metal ring gasket, such as a BX or an RX ring gasket, both of which are well known in the art. A plurality of axial bores 126 accommodate flange bolts for connecting another wellhead component to the permanent fracturing spool 100*b*. All other aspects of the permanent fracturing spool 100*b* have been described above with reference to FIG. 1.

Figure 3:
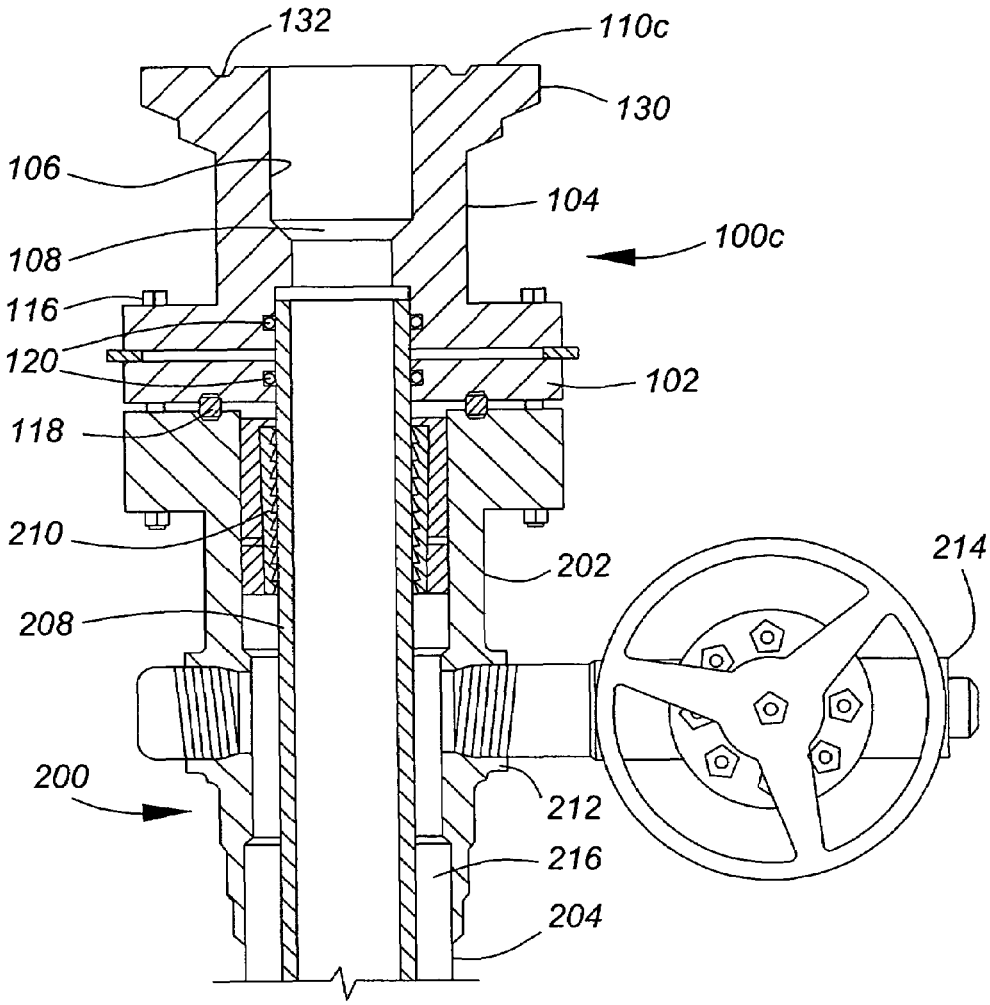
FIG. 3 is a schematic diagram of yet another embodiment of a permanent fracturing spool in accordance with the invention mounted to the prior art casing head.

FIG. 3 is a cross-sectional schematic diagram of yet another embodiment of a permanent fracturing spool 100*c* in accordance with the invention. The permanent fracturing spool 100*c* also has a continuous sidewall 104 without side ports and is identical to the permanent fracturing spools 100*a*, 100*b* described above, with an exception that a top end 110*c* is configured for a Grayloc® type of connector (hereinafter referred to as a "clamp connector"), many variations of which are well known in the art. A seal ring groove 132 in the top end 110*c* accommodates a metal seal ring or a corresponding part of another clamp connector type of flange for providing a high-pressure metal-to-metal seal. All other aspects of the permanent fracturing spool 100*c* are as described above with reference to FIG. 1.

Figure 4:
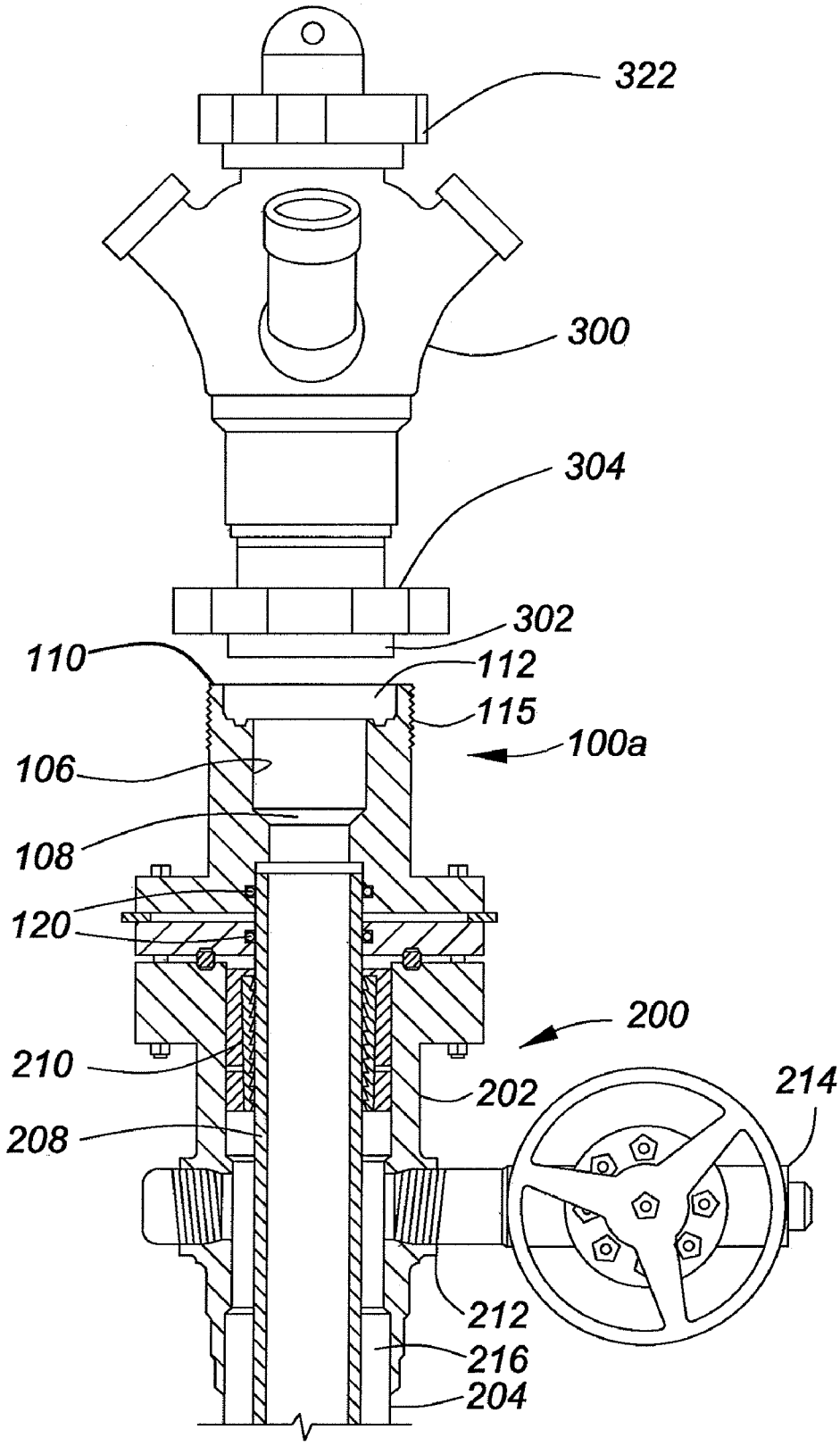
FIG. 4 is a schematic diagram of a fracturing head being amounted to the permanent fracturing spool shown in FIG. 1.

FIG. 4 is a schematic diagram partially in cross-section of a fracturing head 300 suspended over the permanent fracturing spool 100*a* shown in FIG. 1. The fracturing head 300 is equipped with a quick-disconnect high-pressure threaded union coupling that includes a pin end 302 that is received in the socket 112 of the permanent fracturing spool 100*a*, described above with reference to FIG. 1. A hammer nut 304 engages the pin threads 115 on the top end 110 of the permanent fracturing spool 100*a* to secure the fracturing head 300 to the permanent fracturing spool 100*a*. The fracturing head 300 is hoisted onto the permanent fracturing spool 100*a* using a lifting sub 322 in a manner well known in the art.

Figure 5:
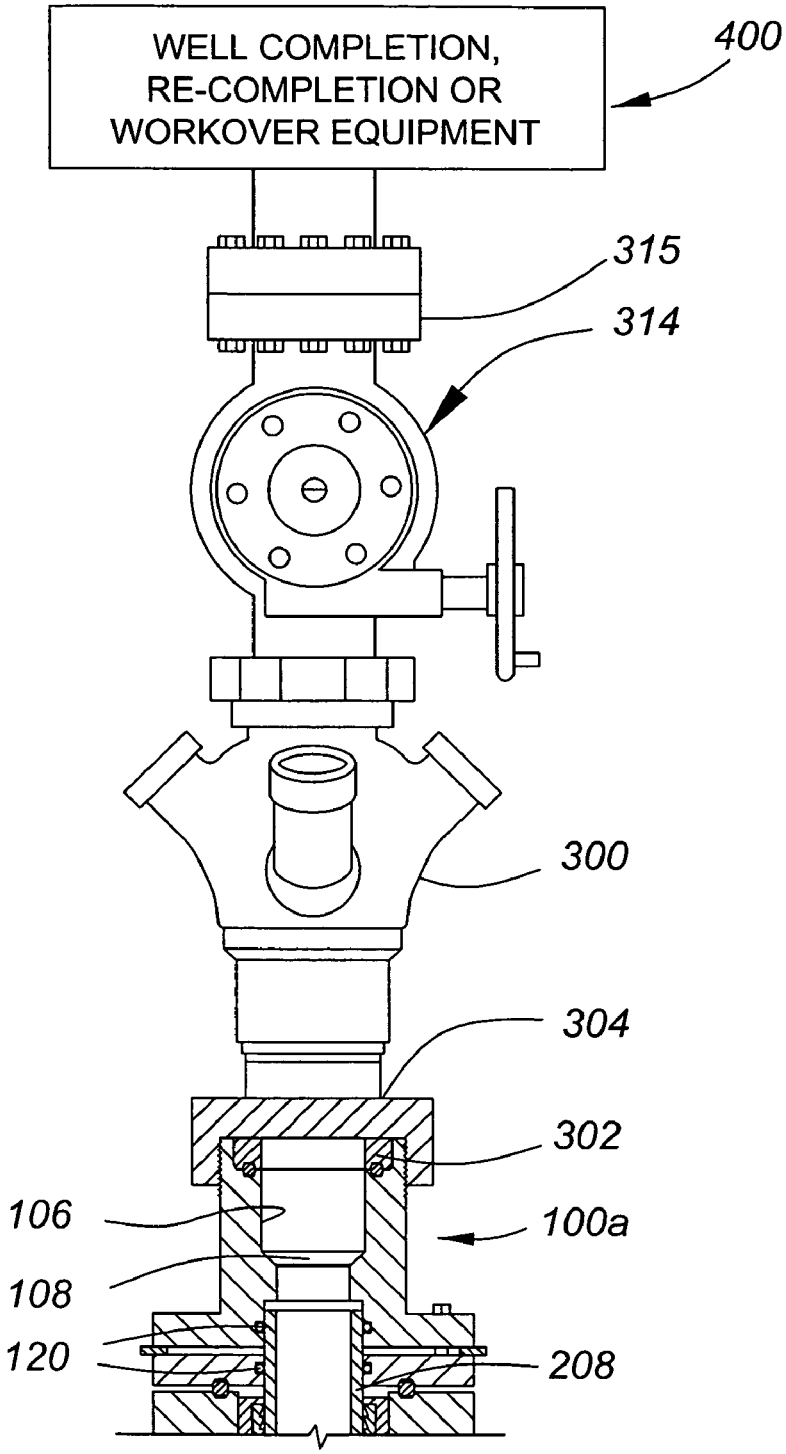
FIG. 5 is a schematic diagram of the permanent fracturing spool configured for a well completion, re-completion or workover operation.

FIG. 5 is a schematic diagram partially in cross-section of the fracturing head 300 mounted to the permanent fracturing spool 100*a*. A high-pressure valve 314 is mounted to a top of the fracturing head 300 and controls access to the production casing 208 in a manner well known in the art. Well completion, re-completion or workover equipment 400 is mounted to a top flange 315 of the high-pressure valve 314. The well completion, re-completion or workover equipment 400 may include any one or more of the following: a lubricator tube; a coil tubing injector; a wireline grease injector; a blowout preventer; a coil tubing blowout preventer; a wireline blowout preventer; or any other tool required for well completion, re-completion or workover.

Figure 6:
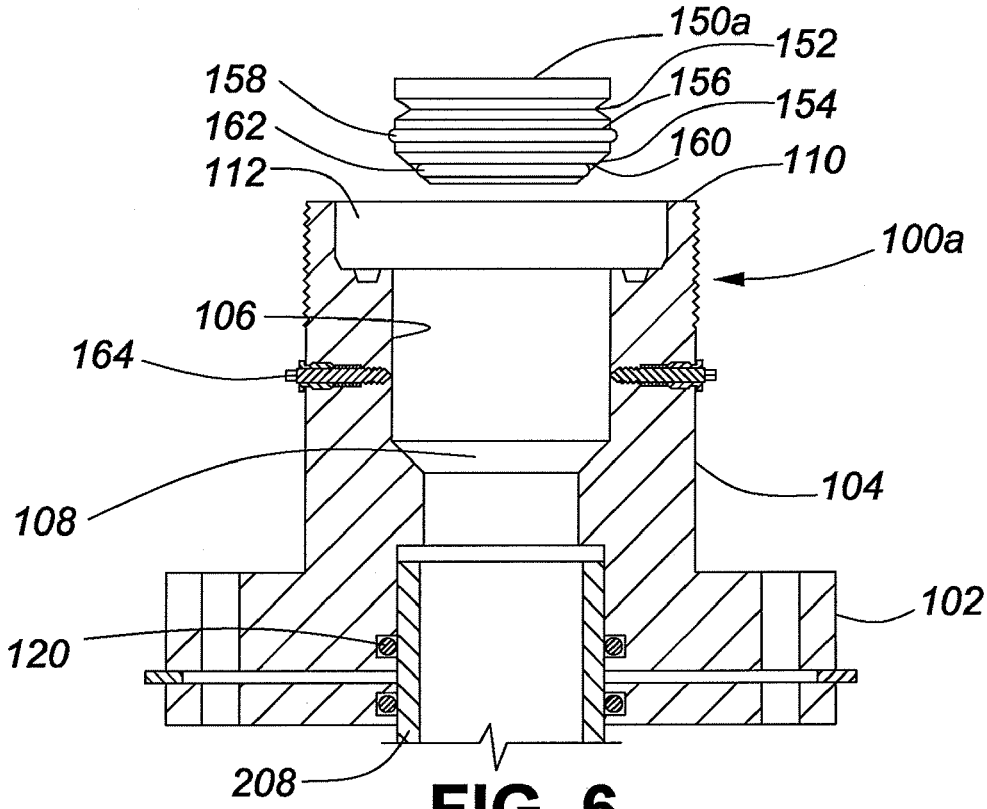
FIG. 6 is a schematic diagram of one embodiment of a fracturing spool plug suspended over the permanent fracturing spool shown in FIG. 1.

FIG. 6 is a schematic diagram partially in cross-section of a fracturing spool plug 150*a* suspended over a permanent fracturing spool 100*a* configured with lockdown screws 164 for retaining the fracturing spool plug 150*a* in a fluid sealing position. As is well understood in the art, after a well is completed, re-completed or worked over, the well is "live" and generally contains natural well pressure that must be controlled to prevent an escape of hydrocarbons to the atmosphere. Consequently, before well completion, re-completion or workover equipment can be removed from the permanent fracturing spools 100*a-c*, the casing 208 must be plugged or the well must be "killed". As is also well understood in the art, "killing" a well is undesirable as well as expensive. While plugging the casing 208 of the well has no undesirable side effects, a wireline operation is required and that tends to be expensive. It is therefore desirable to provide a permanent fracturing spool that accepts a plug which can readily be installed from the surface using low-cost equipment that is readily available. The fracturing pool plug 150*a* is one embodiment of such a plug.

The fracturing spool plug 150*a* includes an annular V-shaped groove 152 that is engaged by lockdown screws 164, which are pressure rated for at least 10,000 psi. The lockdown screws 164 retain the fracturing spool plug 150*a* in the seal bore 106 of the permanent fracturing spools 100*a-c*. A beveled bottom edge 154 of the fracturing spool plug 150*a* mates with the bit guide 108 of the permanent fracturing spool 100*a*. The fracturing spool plug 150*a* includes two annular O-ring grooves 156 and 160. The O-ring grooves 156 and 160 respectively retain high-pressure O-rings 158 and 162.

Figure 7:
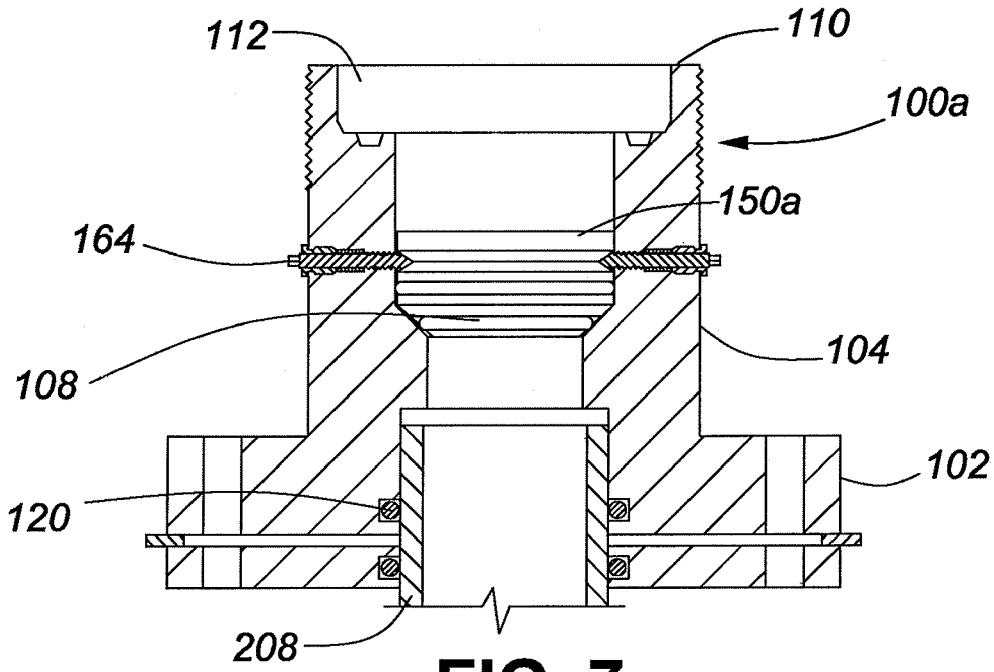
FIG. 7 is a schematic diagram of the permanent fracturing spool plug shown in FIG. 6 set in the permanent fracturing spool shown in FIG. 1.

FIG. 7 shows the fracturing spool plug 150*a* installed in the permanent fracturing spool 100*a*. As will be understood by those skilled in the art, the fracturing spool plug 150*a* can be installed in the permanent fracturing spool 100*a* by an operation known as a "pump down", in which fluid pressure is used to force the fracturing spool plug down through the high-pressure valve 314, the fracturing head 300 and into the seal bore 106 shown in FIG. 6. Alternatively, the fracturing spool plug 150*a* can be installed using a backpressure plug tool, which will be explained below in more detail.

Figure 8:
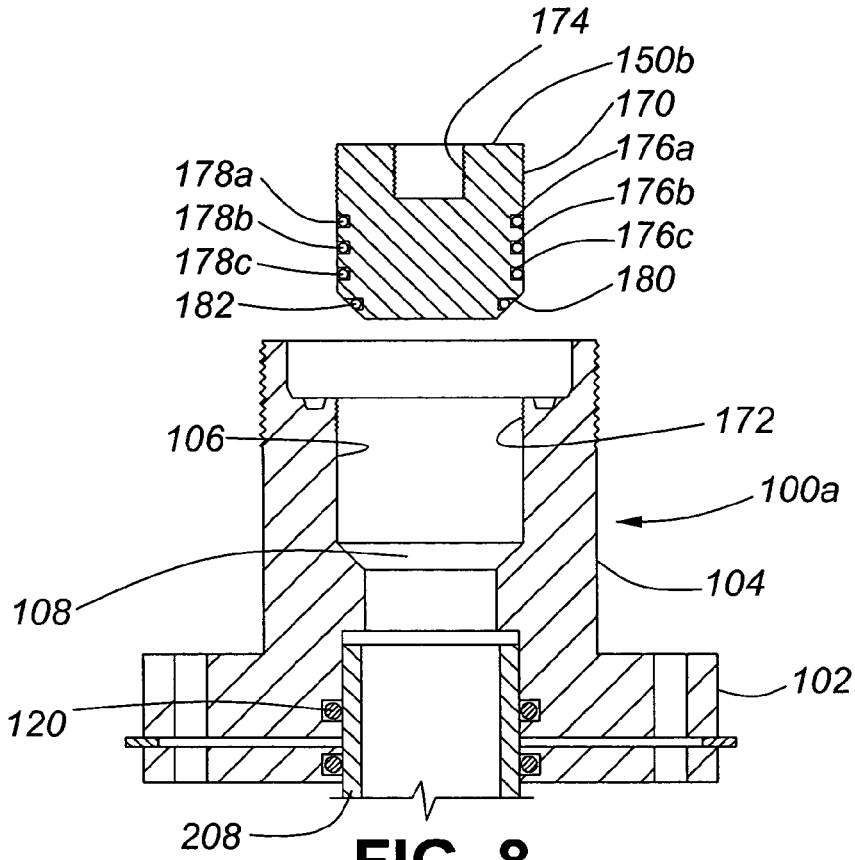
FIG. 8 is a schematic diagram another embodiment of a permanent fracturing spool plug suspended above the permanent fracturing spool shown in FIG. 1.

FIG. 8 is a cross-sectional diagram of another embodiment of a fracturing spool plug 150*b* in accordance the invention. A top end of an outer periphery of the fracturing spool plug 150*b* includes pin threads 170 which engage box threads 172 in a top of the seal bore 106 of the permanent fracturing spool 100*a*. A socket 174, which includes a left-hand box thread, receives a left-hand pin threaded back pressure plug adapter of a back pressure plug tool for setting the fracturing spool plug 150*b* in the seal bore 106 of the permanent fracturing spool 100*a*. A bottom end of the outer periphery includes O-ring grooves 176*a*-176*c*, which respectively receive high-pressure O-rings 178*a*-178*c* that seal in the seal bore 106. An optional O-ring groove 180 accepts an O-ring 182 that seals against the bit guide 108.

Figure 9:
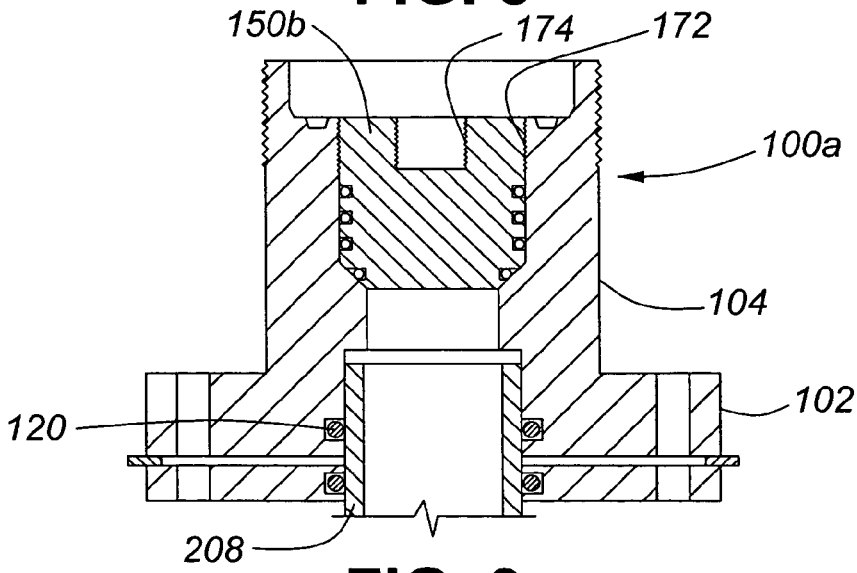
FIG. 9 is a schematic diagram of the permanent fracturing spool plug shown in FIG. 8 set in the permanent fracturing spool shown in FIG. 1.

FIG. 9 shows the fracturing spool plug 150*b* set in the permanent fracturing spool 100*a*.

Figure 10:
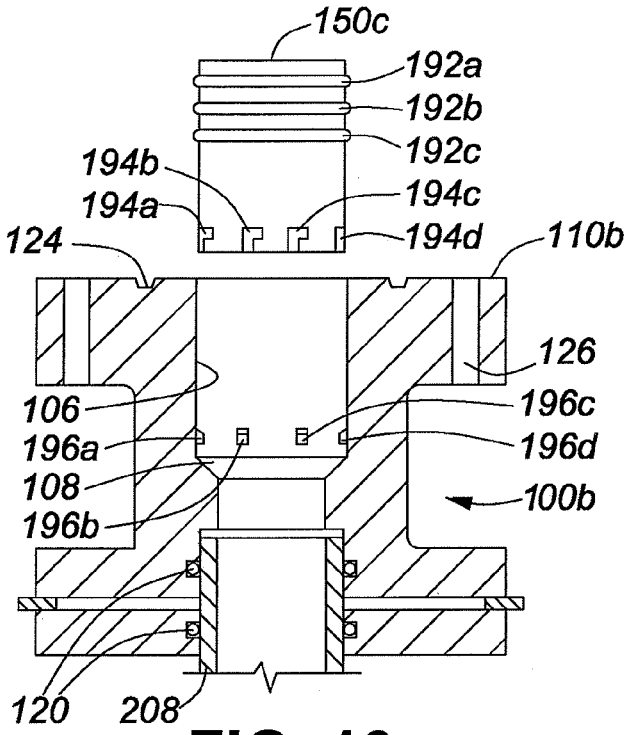
FIG. 10 is a schematic diagram of yet another embodiment of a permanent fracturing spool plug suspended above the permanent fracturing spool shown in FIG. 1.

FIG. 10 is a schematic diagram partially in cross-section of yet another embodiment of a fracturing spool plug 150*c* in accordance the invention. The fracturing spool plug 150*c* shown in FIG. 10 is a cylindrical plug having j-lock grooves 194*a*-194*d* that engage j-lock anchors 196*a*-196*d* above the bit guide 108 in the seal bore 106 when the fracturing spool plug 150*c* is installed in the permanent fracturing spool 100*b*.

Figure 11:
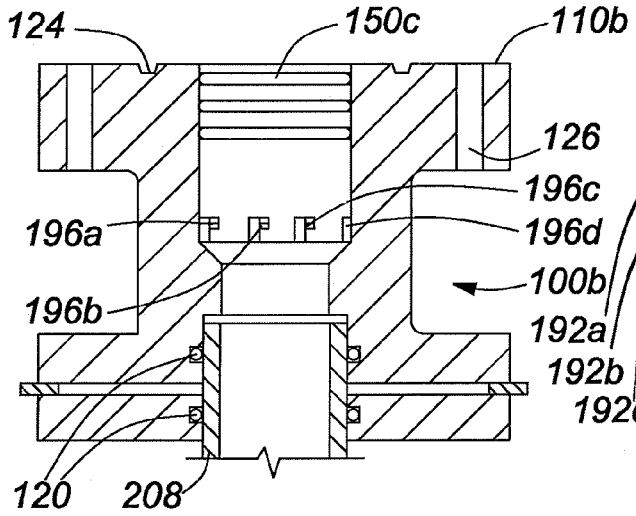
FIG. 11 is a schematic diagram of the permanent fracturing spool plug shown in FIG. 10 set in the permanent fracturing spool shown in FIG. 1.

FIG. 11 shows the fracturing spool plug 150*c* installed in the permanent fracturing spool 100*b*.

Figure 12:
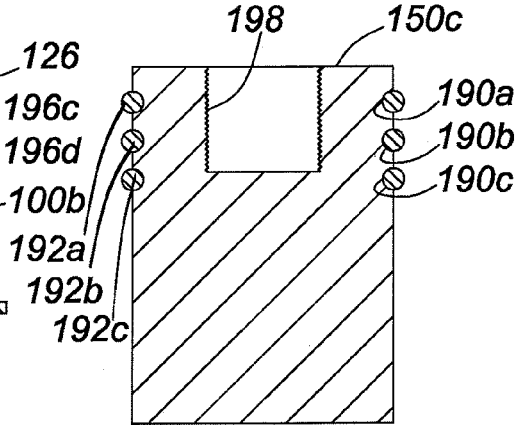
FIG. 12 is a schematic cross-sectional view of the permanent fracturing spool plug shown in FIGS. 10 and 11.

As shown in FIG. 12, high-pressure O-rings 192*a*-192*c* are received in O-ring grooves 190*a*-190*c*. As also shown in FIG. 12, a socket which includes a left-hand box thread 198, receives the left-hand pin threaded back pressure plug adapter of the back pressure plug tool for setting the fracturing spool plug 150*c* in the seal bore 106 of the permanent fracturing spool 100*a*.

It should be understood that although the fracturing spool plugs 150*a*-150*c* have been described with reference to the permanent fracturing spool 100*a*, any one of the permanent fracturing spools 100*a*-100*c* can be configured as described above with lockdown screws, box threads or j-lock anchors for use with any one of the fracturing spool plugs 150*a*-150*c*.

Figure 13:
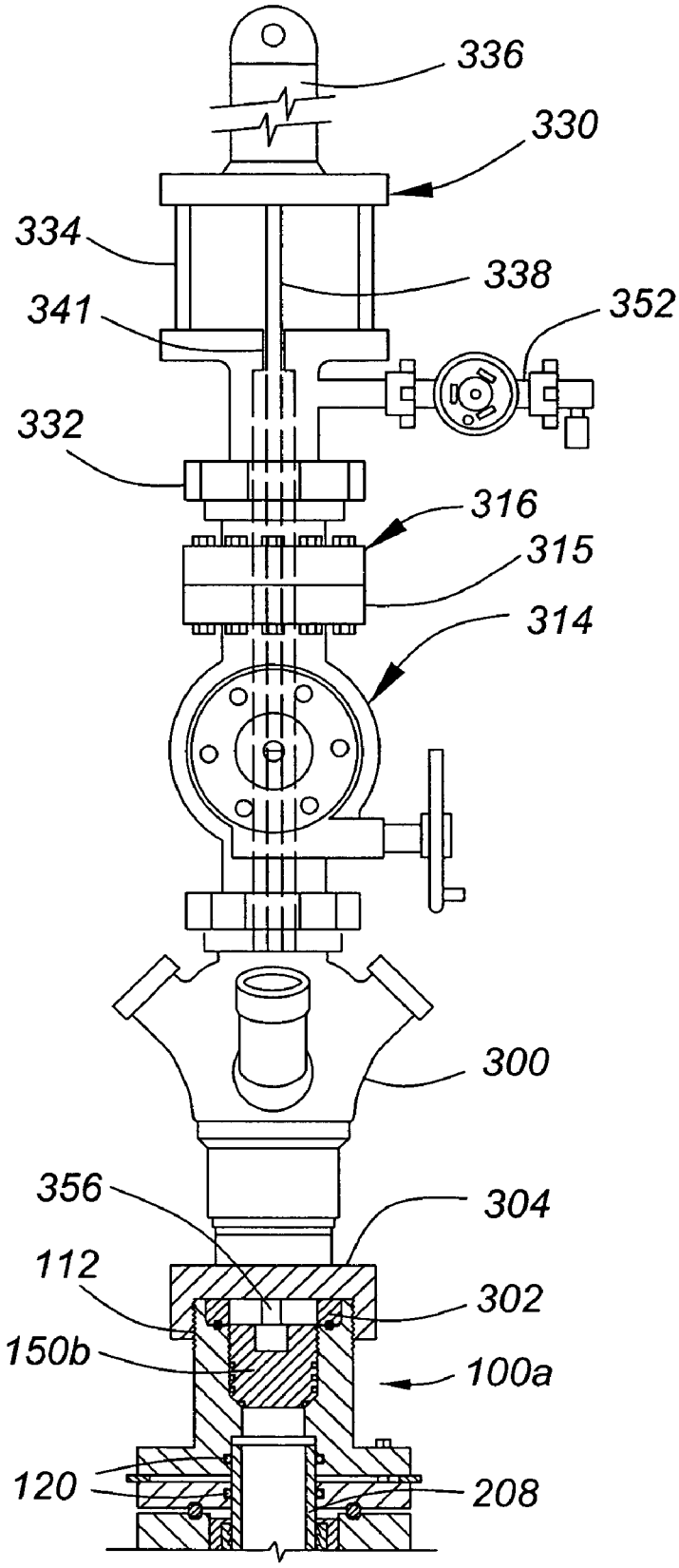
FIG. 13 is a schematic diagram of a back pressure plug setting tool mounted to a high-pressure valve shown in FIG. 5, the back pressure plug setting tool being used to lubricate in and set the fracturing spool plug shown in FIGS. 8 and 9.

FIG. 13 is a schematic diagram of a back pressure plug setting tool 330 being used to set the fracturing spool plug 150*b* in the permanent fracturing spool 100*a* shown in FIGS. 8 and 9. The back pressure plug setting tool 330 schematically shown in FIG. 13 is mounted to a threaded union adapter 316 using a threaded union hammer nut 332. The back pressure plug setting tool 330 includes a hydraulic injector cylinder 336 supported by plurality of stay rods 334. A cylinder rod 338 of the injector cylinder 336 is connected to a back pressure plug tool adapter 356, which in turn connects to fracturing spool plug 150*b*. The cylinder rod 338 reciprocates through a stuffing box 341, which provides a high-pressure fluid seal around the cylinder rod 338. After the back pressure plug setting tool 330 is mounted to the high-pressure valve 314, fluid pressure is balanced across the high-pressure valve 314 using a high-pressure line (not shown) connected to a pressure balance port 352 of the back pressure plug setting tool 330 and a pressure balance port (not shown) on the high-pressure valve 314, in a manner well known in the art.

As explained above, the pin threads 170 on the fracturing spool plug 150*b* (see FIG. 8) are right-hand threads, whereas the back pressure plug tool adapter 356 engages the fracturing spool plug 150*b* with a left-hand thread. Consequently, once the fracturing spool plug 150*b* is firmly engaged with the box threads 172 (see FIG. 9), the back pressure plug tool adapter 356 can be further rotated to release it from the fracturing spool plug 150*b*. The back pressure plug setting tool 330 is then removed from the threaded union adapter 316 by releasing the hammer nut 332 after the back pressure plug tool adapter 356 is stroked up through the high-pressure valve 314, a fluid path though the fracturing head 300 is closed by closing the high-pressure valve 314, and fluid pressure is bled off through the pressure balance port 352.

Figure 14:
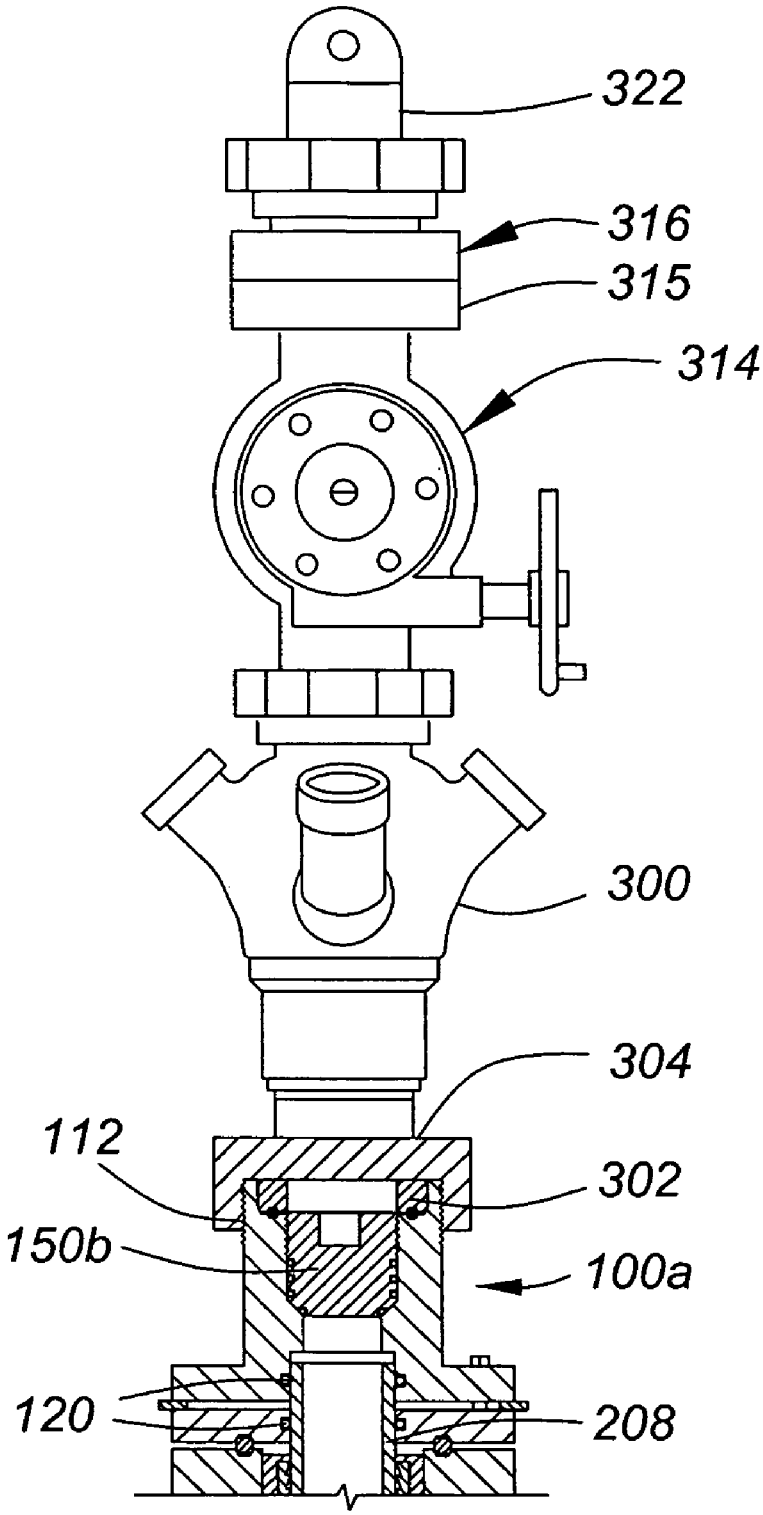
FIG. 14 is a schematic diagram of the wellhead shown in FIG. 13 with the back pressure plug setting tool removed and a lifting sub mounted to the high-pressure valve.

As shown in FIG. 14, the lifting sub 322 is then connected to the threaded union adapter 316 and the high-pressure valve 314 and the fracturing head 300 are removed from the permanent fracturing spool 100*a*.

Figure 15:
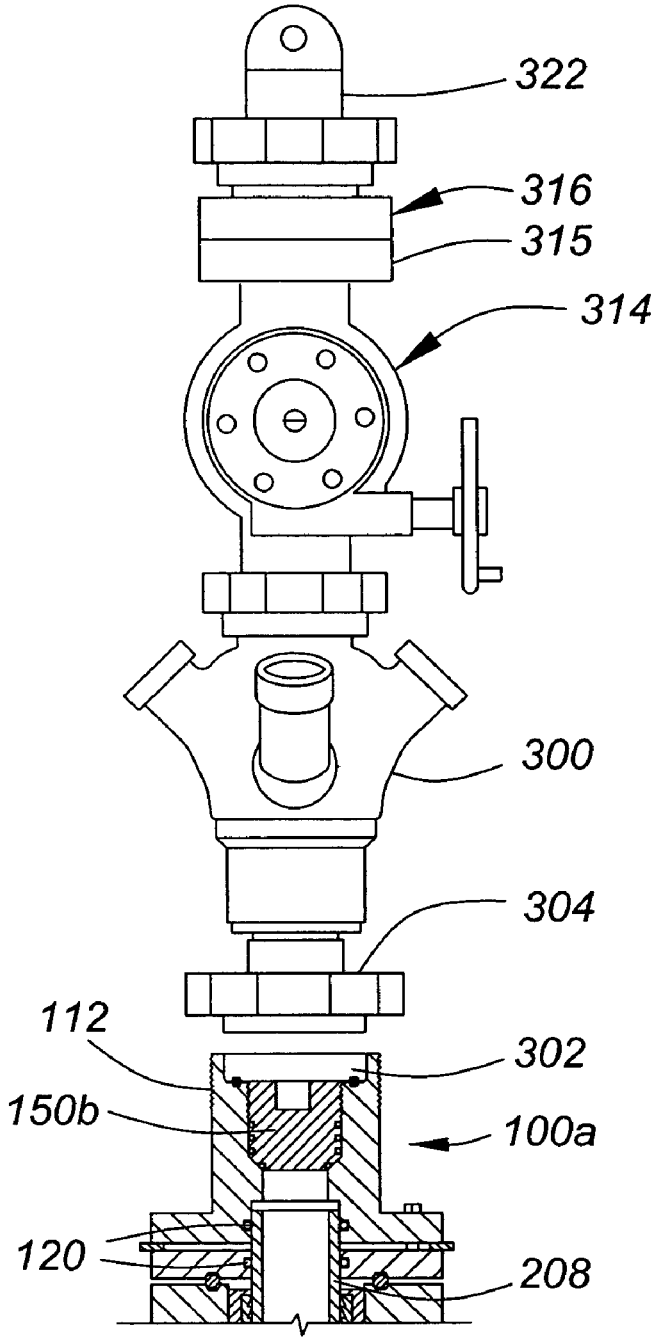
FIG. 15 is a schematic diagram of the fracturing head removed from the permanent fracturing spool shown in FIG. 14.

FIG. 15 shows the high-pressure valve 314 and the fracturing head 300 being hoisted away from the permanent fracturing spool 100*a* using the lifting sub 322.

Figure 16:
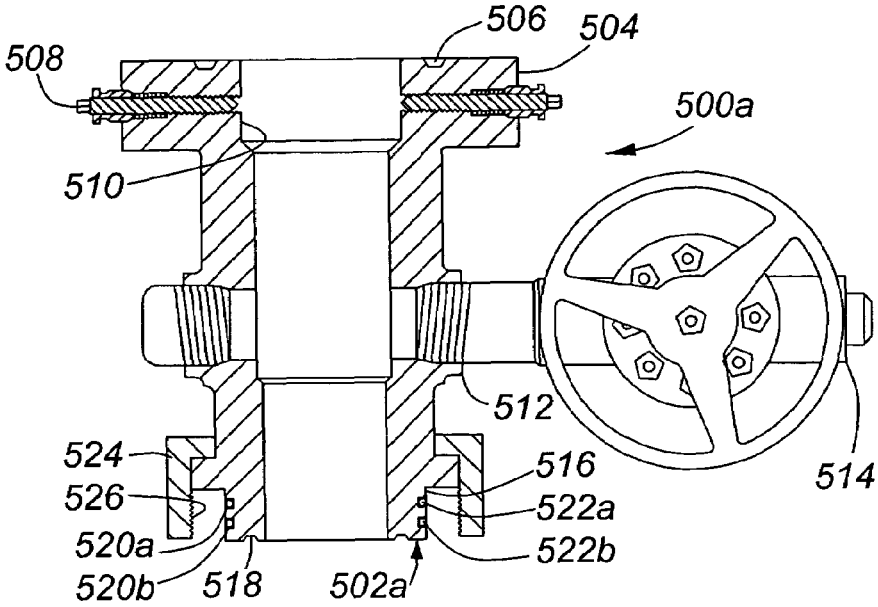
FIG. 16 is a schematic diagram of one embodiment of a tubing head for use in the configurable wellhead system in accordance with the invention.

FIG. 16 shows a diagram partially in cross-section of one embodiment of a tubing head 500*a* for use in the configurable wellhead system in accordance the invention. The tubing head 500*a* includes a bottom end 502*a* with a high-pressure threaded union that includes a pin 516 dimensioned to be received in the socket 112 of the permanent fracturing spool 100*a* (see FIG. 1). The pin 516 includes a metal ring gasket groove 518 that mates with the metal ring gasket groove 114 in the permanent fracturing spool 100*a*. Optional O-ring grooves 520*a*, 520*b* receive high-pressure O-rings 522*a*, 522*b* to back up a metal ring gasket received in the metal ring gasket grooves 518 and 114. A threaded union hammer nut 524 has box threads 526 that engage the pin threads 115 on the top end 110 of the permanent fracturing spool 100*a* . A top flange 504 of the tubing head 500*a* accommodates tubing hanger lockdown screws 508, well known in the art for locking down an optional tubing hanger (not shown). A tubing bowl 510 supports the tubing hanger if tubing is run into the completed well. A ring gasket groove 506 accepts a metal ring gasket, such as a BX ring gasket. Side ports 512 accept a side port valve 514 that controls fluid flow from an annulus of the tubing head 500*a*.

Figure 17:
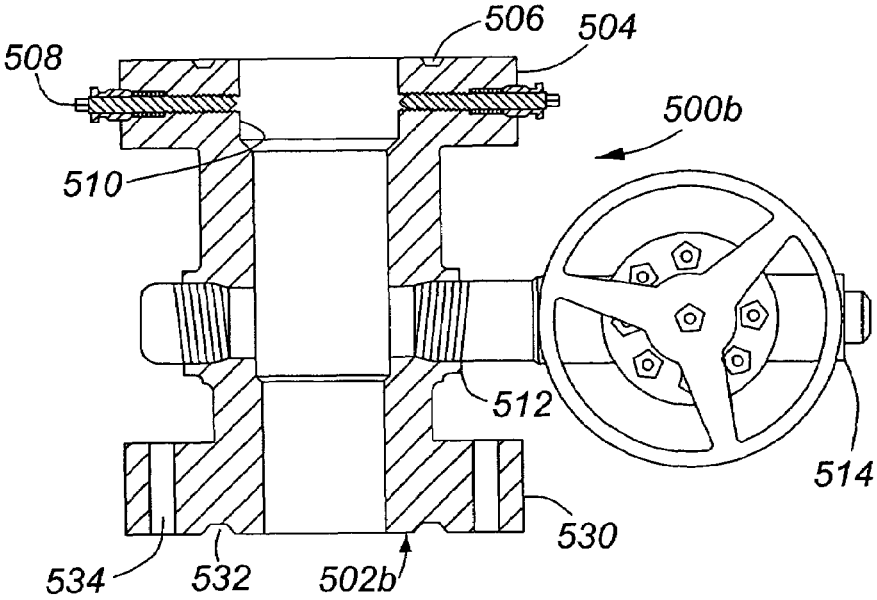
FIG. 17 is a schematic diagram of another embodiment of a tubing head for use in the configurable wellhead system in accordance the invention.

FIG. 17 is a schematic diagram partially in cross-section of another embodiment of a tubing head 500*b* for use with the configurable wellhead system in accordance the invention. The tubing head 500*b* is identical to the tubing head 500*a* described above with reference to FIG. 15, with the exception that the bottom end 502*b* includes a standard bolted flange 530 having a metal ring gasket groove 532 that accepts a standard metal ring gasket, such as a BX ring gasket. The bottom flange 530 further includes a plurality of flange bolt bores 534 that receive flange bolts for connecting the tubing head 500*b* to the permanent fracturing spool 100*b* shown in FIG. 2.

Figure 18:
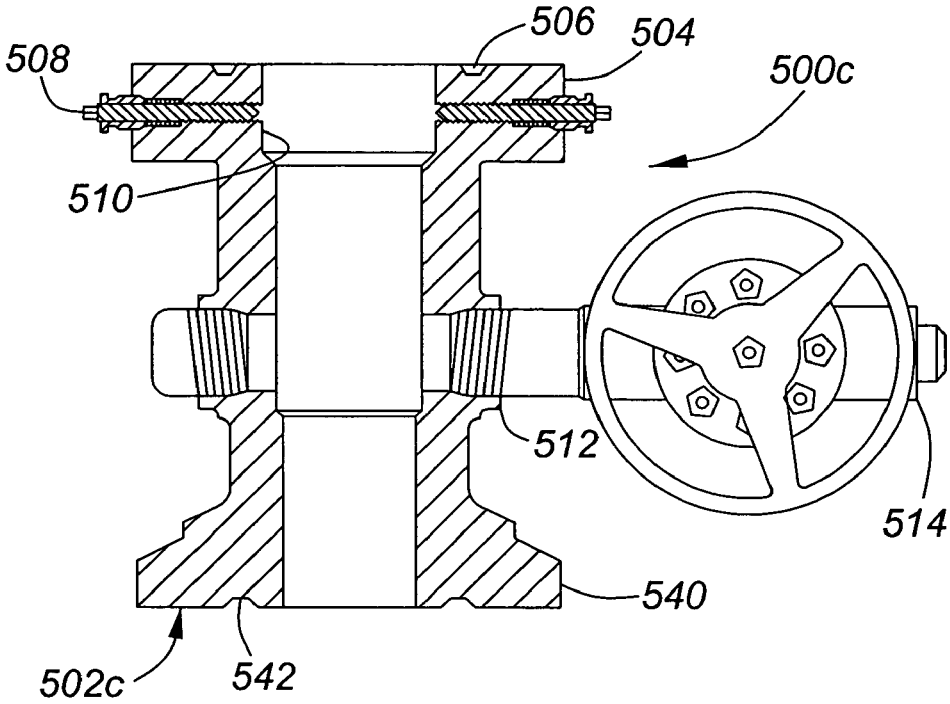
FIG. 18 is a schematic diagram of yet another embodiment of a tubing head for use in the configurable wellhead system in accordance with the invention.

FIG. 18 is a schematic diagram partially in cross-section of yet another embodiment of a tubing head 500*c* for use with the configurable wellhead system in accordance with the invention. The tubing head 500*c* is identical to the tubing heads 500*a*, 500*b* described above with reference to FIGS. 16 and 17, with the exception that the bottom end that 502C includes a flange 540 configured for the clamp connector. The flange 540 includes a metal ring gasket groove 542 that accepts a metal ring gasket, such as a BX ring gasket, or a corresponding part of another clamp connector flange for providing a high-pressure metal-to-metal seal.

Figure 19:
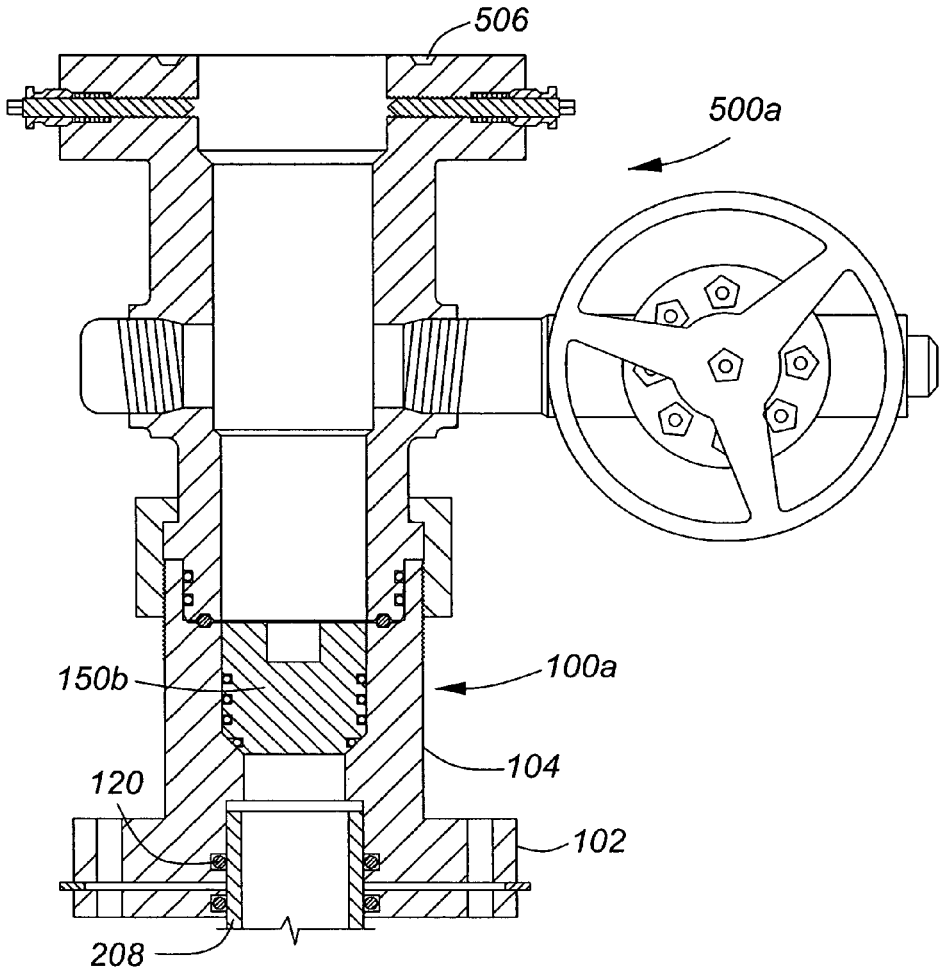
FIG. 19 is a schematic diagram of the tubing head shown in FIG. 15 mounted to the permanent fracturing spool shown in FIG. 9.

FIG. 19 is a schematic diagram partially in cross-section of the tubing head 500*a* mounted to the permanent fracturing spool 100*a* shown in FIG. 9, with the fracturing spool plug in 150*b* installed. As will be understood by those skilled in the art, the tubing heads 500*a*-500*c* are manufactured in many different weights to withstand various well pressures. For example, the tubing heads 500*a*-500*c* may be manufactured to withstand well pressures of 1500 psi, 2500 psi, 3000 psi or 5000 psi. As is well known in the art, the lower the pressure tolerance of a wellhead component, the less expensive that component is to manufacture. Consequently, the choice of a tubing head can be postponed until a well is completed, re-completed or worked over and the actual pressure on the live well has been measured. This permits a tubing head to be selected that is tailored to the completed well. Costs are therefore more precisely controlled.

Figure 20:
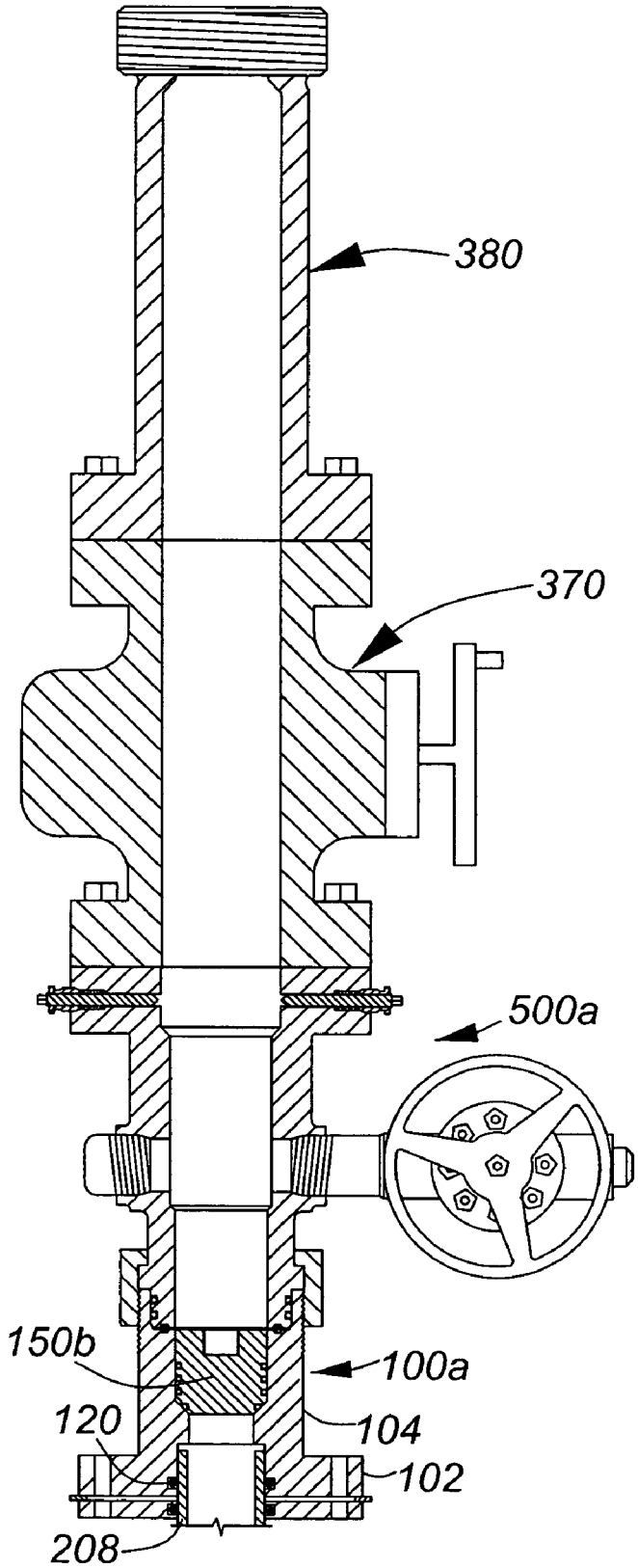
FIG. 20 is a schematic diagram of the wellhead shown in FIG. 19 with a master valve and lubricator tube mounted to the wellhead.

FIG. 20 is a schematic diagram partially in cross-section of the wellhead shown in FIG. 19, with a master valve 370 and a lubricator tube 380 mounted thereto.

Figure 21:
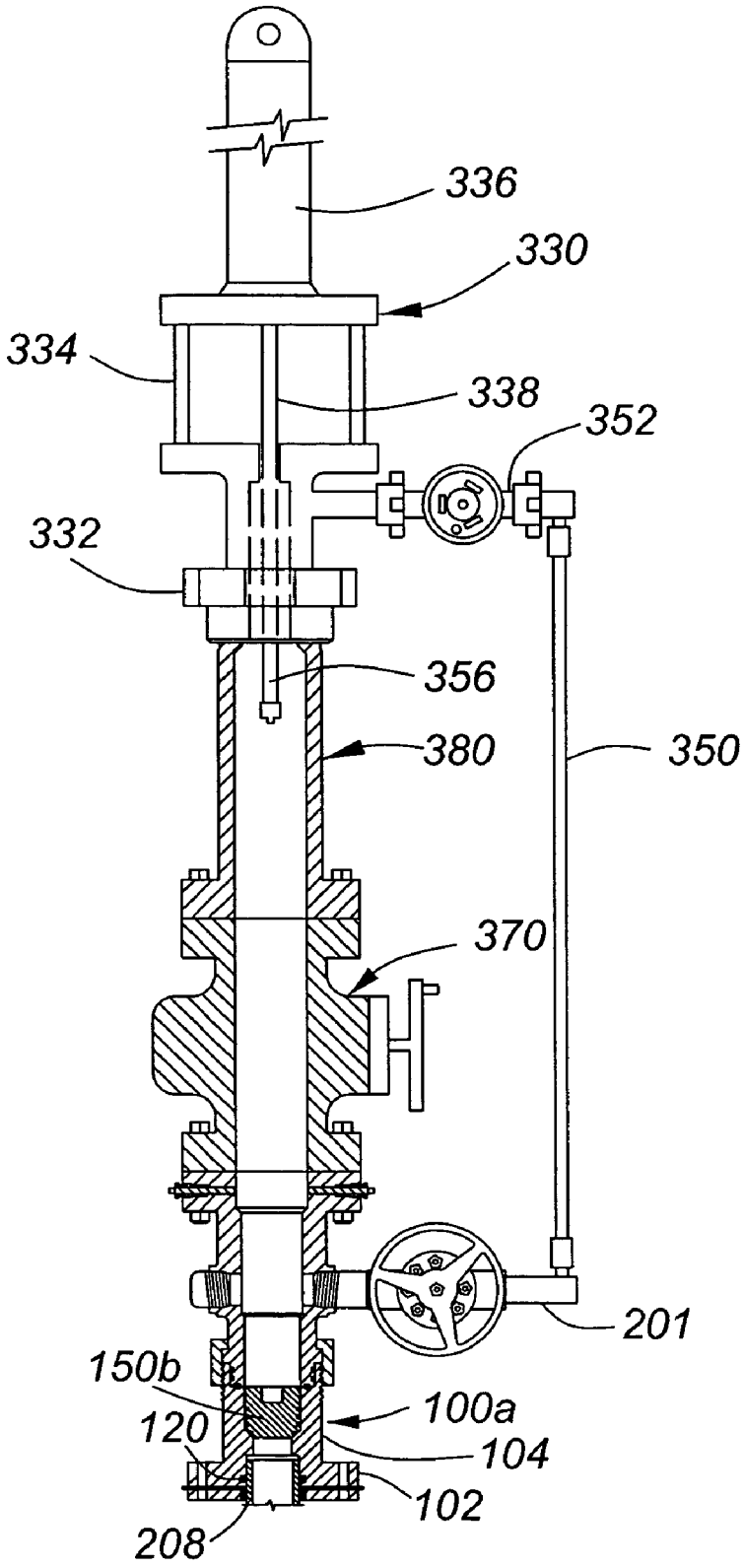
FIG. 21 is a schematic diagram of the wellhead shown in FIG. 20 with the back pressure plug setting tool mounted to a top of the lubricator tube.

As shown in FIG. 21, the back pressure plug setting tool 330 is then mounted to a top of the lubricator tube 380 using the hammer nut 332, and the back pressure plug tool adapter 356 is stroked through the lubricator tube 380 and the master valve 370 and connected to the fracturing spool plug 150*b*, as shown in FIG. 21.

Figure 22:
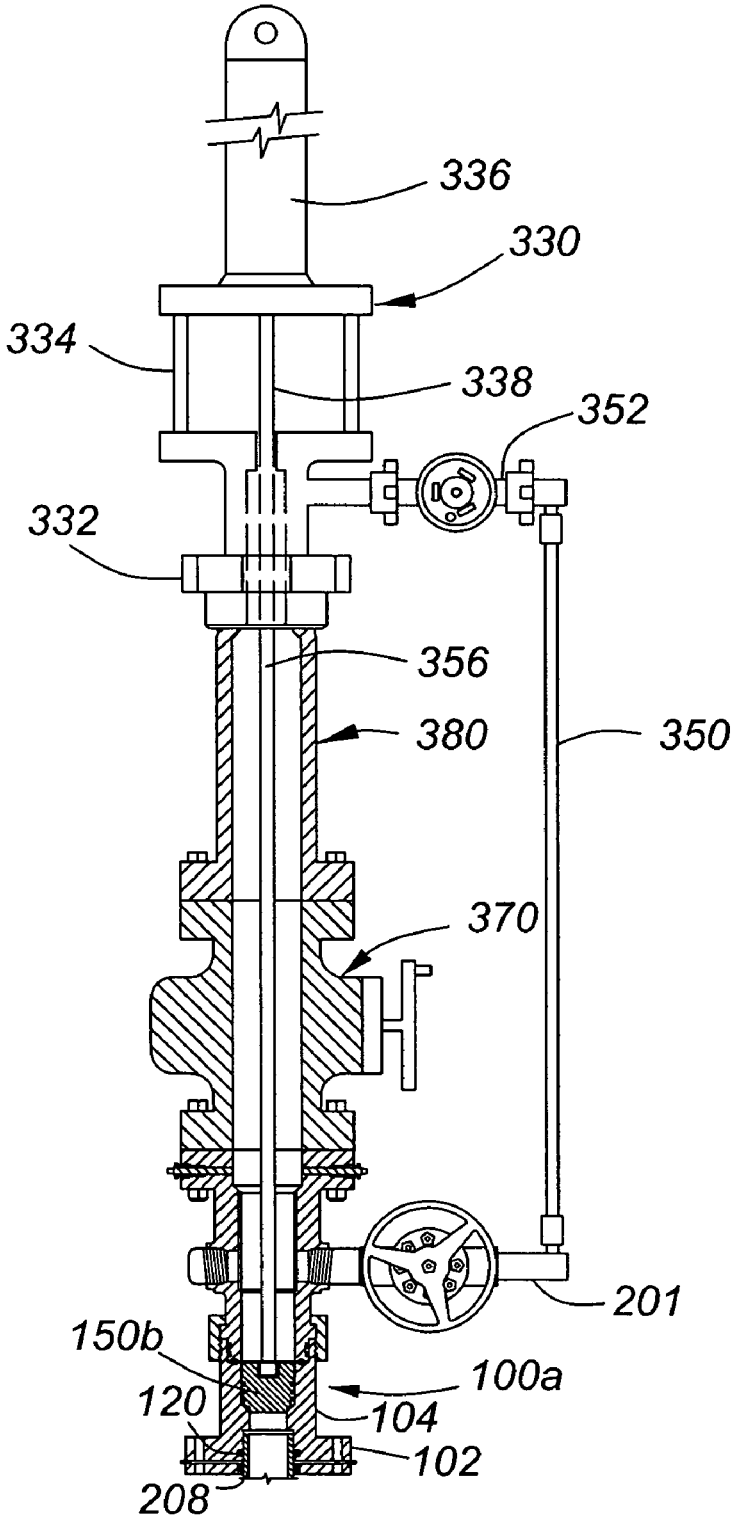
FIG. 22 is a schematic diagram of the wellhead shown in FIG. 21, with a plug adapter of the back pressure plug setting tool connected to the fracturing spool plug shown in FIG. 21.
Figure 23:
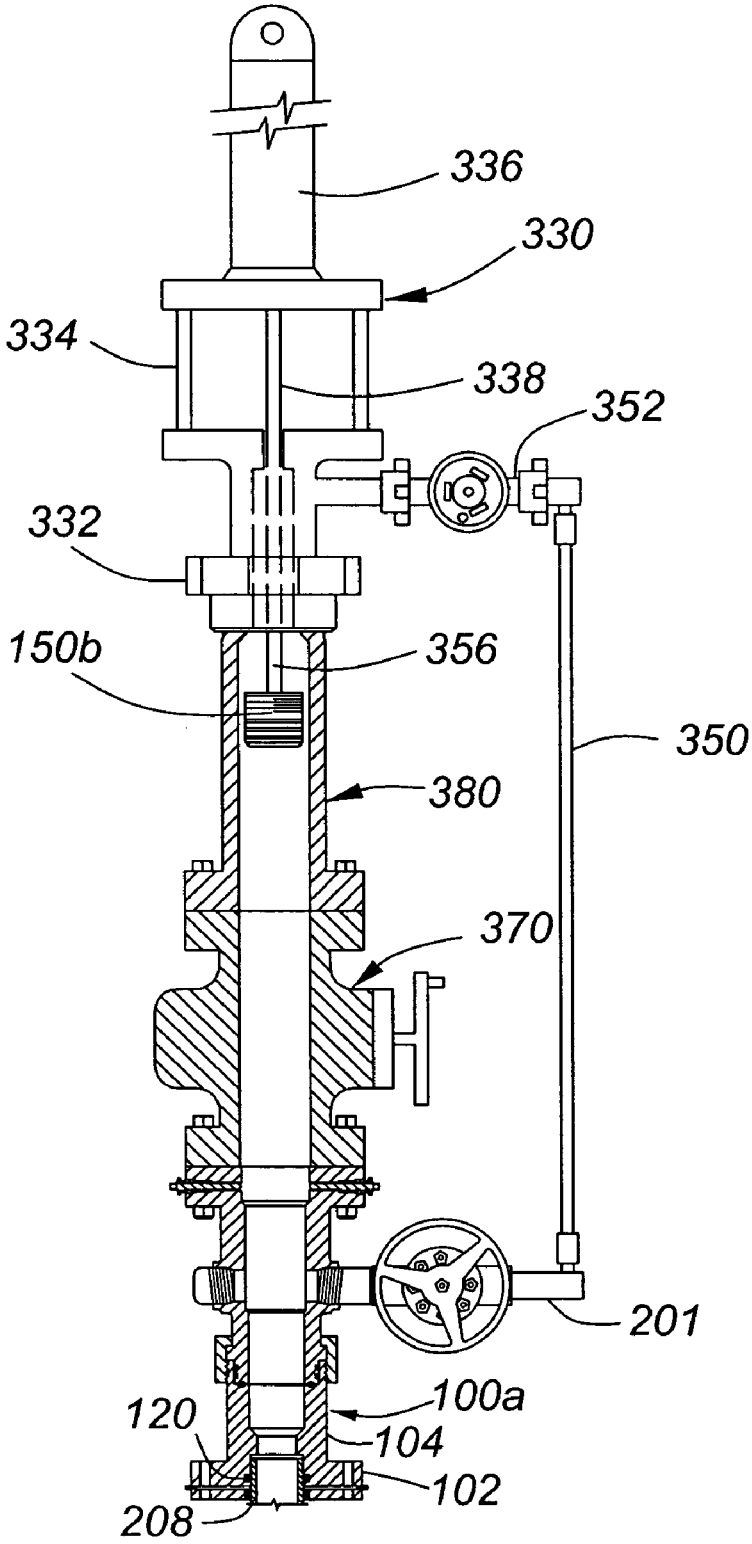
FIG. 23 is a schematic diagram of the fracturing spool plug drawn up into the lubricator tube shown in FIG. 22.

Well pressure is then balanced across the fracturing spool plug 150*b* using a high-pressure line 350 connected between the side port 201 and the pressure balance port 352, as shown in FIG. 22. The backpressure plug setting tool 330 is then operated to release the fracturing spool plug 150*b* from the permanent fracturing spool 100*a*, and the hydraulic cylinder 336 of the back pressure plug setting tool 330 is operated to pull the fracturing spool plug 150*b* up into the lubricator tube 380 as shown in FIG. 23.

Figure 24:
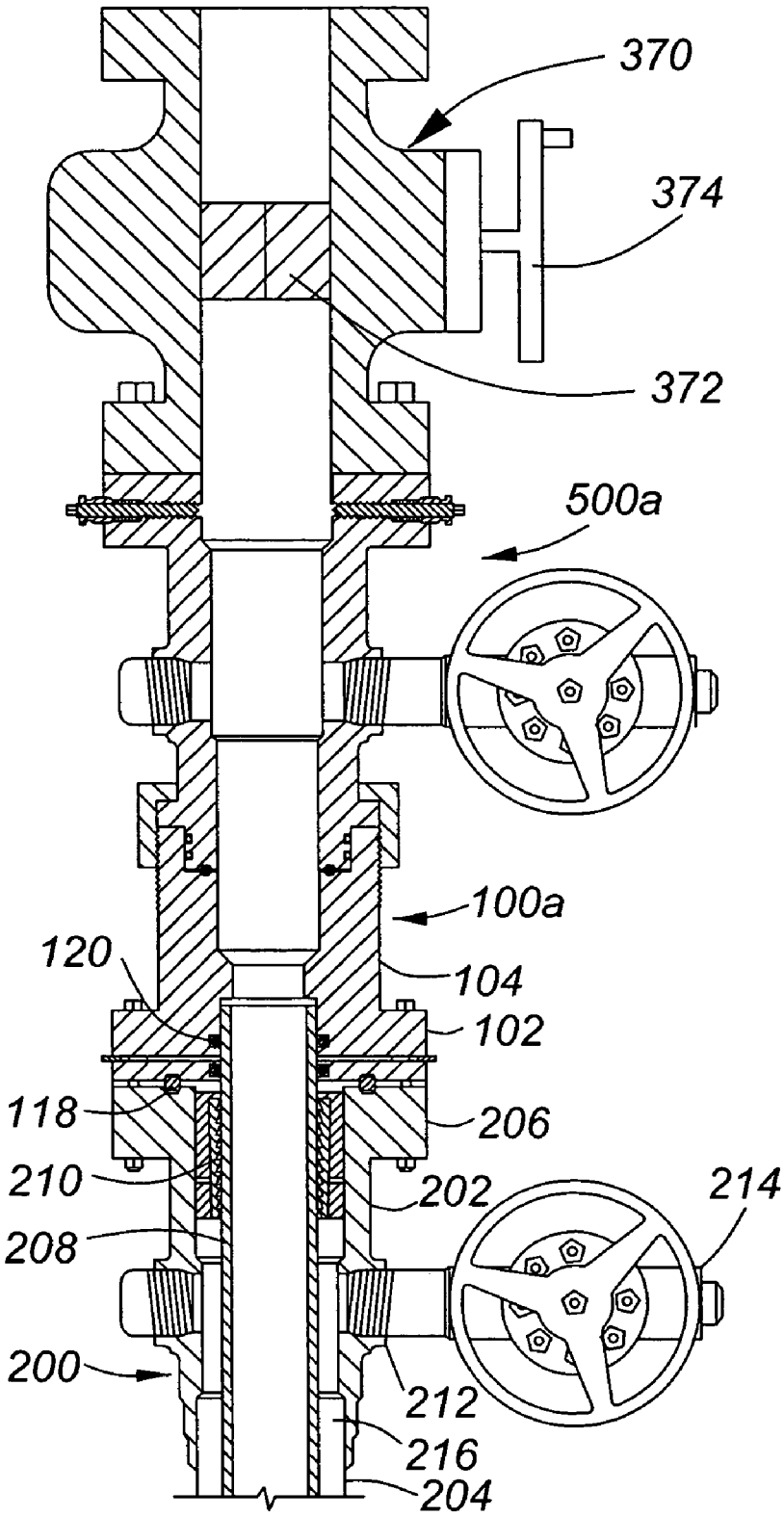
FIG. 24 is a schematic diagram of the wellhead system in accordance with the invention ready to be configured for production.

Once the fracturing spool plug 150*b* is drawn up into lubricator tube 380, the master valve 370 is closed to control the well, the high-pressure line 350 is disconnected and pressure is bled off through the pressure balance port 352 to permit the lubricator tube 380 to be disconnected from the master valve 370. The lubricator tube 380 and the back pressure plug setting tool 330 are then removed from the master valve 370 and the well is ready to be prepared for production as shown in FIG. 24.

Depending on the type of the hydrocarbon formation(s) with which the well communicates, a production tubing may be run into the well and suspended in the well using a tubing hanger (not shown) supported by the tubing head 500*a*. Alternatively, a production tree may be connected directly to a top of the master valve 370 and a gate 372 of the master valve 370 opened using a valve control wheel 374, shown in FIG. 24.

If at any future time the well needs to be re-completed or re-worked, a reverse of the process shown in FIGS. 19-24 is performed to install an appropriate fracturing spool plug 150*a*-150*c* in the seal bore 106. The well re-completion or workover equipment 400 (see FIG. 5) is then installed as described above, the fracturing spool plug 150*a*-150*c* is lubricated out of the permanent fracturing spool 100*a*-100*c*, and full-bore direct access to the well permits any required downhole process to be performed without installing a wellhead isolation tool. Time and expense are therefore conserved.

While various alternative constructions of the permanent fracturing spools 100*a*-100*c*, the fracturing spool plugs 150*a*-150*c* and the tubing heads 500*a*-500*c* of the configurable wellhead system in accordance with the invention have been described, it should be understood that the embodiments described above are exemplary only.

Although the invention provides permanent fracturing spools 100*a*-100*c* that accept fracturing spool plugs 150*a*-150*c* in order to conserve time and cost, it should be understood that the use of the wellhead system in accordance with the invention is in no way dependent on the use of the fracturing spool plugs, and a wireline set casing plug, a freeze-set plug, or any other method of temporarily obstructing an annulus of the production casing can likewise be effectively used with the configurable wellhead system described above without departing from the spirit or scope of the invention.

The scope of the invention is therefore intended to be limited solely by the scope of the appended claims.

I claim:

1. A configurable wellhead system for facilitating well completion, re-completion or workover of a cased well, comprising:

a permanent fracturing spool having a top end and a continuous sidewall without side ports, the permanent fracturing spool having a central passage at least as large as a diameter of a casing of the cased well, a bottom flange for mounting to a casing head of the cased well, and high pressure seals for sealing around a periphery of a top end of the casing; and a tubing head having a bottom end that is mounted to the top end of the permanent fracturing spool to complete the configurable wellhead system, the tubing head including a tubing bowl, tubing hanger lockdown screws, and at least one side port that communicates with an annulus of the tubing head.

2. The configurable wellhead system as claimed in claim 1 further comprising a fracturing spool plug received in a seal bore of the permanent fracturing spool to seal the casing when any component mounted to the top end of the permanent fracturing spool needs to be removed.

3. The configurable wellhead system as claimed in claim 1 wherein the top end of the permanent fracturing spool and the bottom end of the tubing head comprise, in combination, a high-pressure threaded union.

4. The configurable wellhead system as claimed in claim 1 wherein the top end of the permanent fracturing spool and the bottom end of the tubing head comprise, in combination, a bolted flange connection.

5. The configurable wellhead system as claimed in claim 1 wherein the top end of the permanent fracturing spool and the bottom end of the tubing head comprise, in combination, a clamp type connection.

6. The configurable wellhead system as claimed in claim 2 wherein the permanent fracturing spool comprises a seal bore with fracturing spool plug lockdown screws and the fracturing spool plug comprises a V-shaped annular groove engaged by the fracturing spool lockdown screws to retain the fracturing spool plug in the seal bore.

7. The configurable wellhead system as claimed in claim 2 wherein the permanent fracturing spool comprises a seal bore with a box thread and the fracturing spool plug comprises a pin thread for engaging the box thread to retain the fracturing spool plug in the seal bore.

8. The configurable wellhead system as claimed in claim 2 wherein the permanent fracturing spool comprises a seal bore with j-latch anchors and the fracturing spool plug comprises j-latch grooves for engaging the j-latch anchors to retain the fracturing spool plug in the seal bore.

9. The configurable wellhead system as claimed in claim 2 wherein the fracturing spool plug comprises a plurality of O-ring grooves that accept high-pressure O-rings that seal against a sidewall of the seal bore of the permanent fracturing spool.

10. A method of performing a completion, re-completion or workover of a cased well having a casing head, comprising:

mounting a permanent fracturing spool to a top of the casing head;

mounting a fracturing head to the permanent fracturing spool;

mounting a high-pressure valve to a top of the fracturing head;

mounting well completion, re-completion or workover equipment to a top of the high-pressure valve; and performing a well completion, re-completion or workover operation using the equipment.

11. The method as claimed in claim 10 further comprising:

inserting a fracturing spool plug through the high pressure valve and the fracturing head and securing the fracturing spool plug in a seal bore of the permanent fracturing spool;

releasing well pressure above the fracturing spool plug; and removing the well completion, re-completion or workover equipment from the top of the permanent fracturing spool.

12. The method as claimed in claim 11 wherein inserting the fracturing spool plug comprises;

mounting a backpressure plug insertion tool to a top of the high pressure valve;

pressure balancing well pressure across the high-pressure valve;

opening the high-pressure valve;

stroking the fracturing spool plug through the high pressure valve and the fracturing head using the backpressure plug insertion tool;

inserting the fracturing spool plug into the seal bore of the permanent fracturing spool to provide a high pressure fluid seal at a top of a casing of the well;

releasing fluid pressure above the fracturing spool plug; and removing the backpressure plug insertion tool from the high pressure valve.

13. The method as claimed in claim 12 further comprising:

mounting a lifting sub to a top of the high pressure valve and removing the high pressure valve and the fracturing head from the permanent fracturing spool; and mounting a tubing head to a top of the permanent fracturing spool.

14. The method as claimed in claim 13 further comprising:

mounting a master valve and a lubricator tube to a top of the tubing head;

mounting the backpressure plug insertion tool to a top of the lubricator tube;

stroking a plug adapter of the backpressure plug insertion tool down through the lubricator tube and master valve and connecting the plug adapter to the fracturing spool plug in the seal bore of the permanent fracturing spool;

releasing the fracturing spool plug from the seal bore of the permanent fracturing spool; and lifting the fracturing spool plug up into the lubricator tube.

15. The method as claimed in claim 14 further comprising:

closing the master valve;

releasing fluid pressure from the lubricator tube; and removing the lubricator tube and the backpressure plug insertion tool from the master valve.

16. a configurable wellhead system for facilitating well completion, re-completion or workover of a cased well, comprising:

a permanent fracturing spool having a top end, a continuous sidewall without side ports, a central passage defining a seal bore and having a smallest diameter at least as large as a diameter of a casing of the cased well, a bottom flange for mounting to a casing head of the cased well, and high pressure seals for sealing around a periphery of a top end of the casing; and a tubing head having a bottom end that is mounted to the top end of the permanent fracturing spool to complete the wellhead system, the tubing head comprising a top flange, a tubing bowl, tubing hanger lockdown screws, side ports that communicate with an annulus of the tubing hanger, and at least one side port valve connected to a one of the side ports.

17. The configurable wellhead system as claimed in claim 16 further comprising a fracturing spool plug received in the seal bore of the permanent fracturing spool to seal the central passage above the casing when equipment or wellhead components are to be removed from the top end of the permanent fracturing spool.

18. The configurable wellhead system as claimed in claim 17 wherein the seal bore comprises one of: fracturing spool plug lockdown screws that secure the fracturing spool plug in the seal bore; a box thread that secures the fracturing spool plug in the seal bore; and j-latch anchors that secure the fracturing spool plug in the seal bore.

19. The configurable wellhead system as claimed in claim 18 wherein the fracturing spool plug further comprises at least one of: a V-shaped annular groove engaged by the lockdown screws that secure the fracturing spool plug in the seal bore; a pin thread for engaging the box thread that secures the fracturing spool plug in the seal bore; and, j-latch grooves that accept the j-lock anchors that secure the fracturing spool plug in the seal bore.

20. The configurable wellhead system as claimed in claim 16 wherein the top end of the permanent fracturing spool and the bottom end of the tubing head comprise, in combination, one of: a high-pressure threaded union; a bolted flange connection; or a clamp type connector.

* * * * *